United States Patent [19]

Nayfa

[11] Patent Number: 4,625,365

[45] Date of Patent: Dec. 2, 1986

[54] GINNING POINT ASSEMBLY

[76] Inventor: James E. Nayfa, 10310 Woodford, Dallas, Tex. 75229

[21] Appl. No.: 693,389

[22] Filed: Jan. 22, 1985

Related U.S. Application Data

[63] Continuation-in-part of Ser. No. 586,544, Mar. 5, 1984, abandoned.

[51] Int. Cl.[4] ..... D01B 1/08

[52] U.S. Cl. ..... 19/55 R; 19/62 R

[58] Field of Search ..... 19/48 A, 50, 53, 55 R, 19/56, 59, 62 R, 62 A, 48, 55, 62

[56] References Cited

U.S. PATENT DOCUMENTS

| | | | |
|---|---|---|---|
| 351,401 | 10/1886 | Ralston | 19/62 R |
| 364,176 | 5/1887 | Jordan | 19/62 R |
| 374,193 | 12/1887 | Libbey | 19/62 R |
| 1,300,162 | 4/1919 | Grimes | 19/62 R |
| 1,680,132 | 8/1928 | Cox | 19/50 |
| 3,135,021 | 6/1964 | Jennings | 19/56 |
| 3,162,903 | 12/1964 | Wallace | 19/59 |
| 3,369,275 | 2/1968 | Headley | 19/62 R |
| 3,447,843 | 6/1969 | Shipman | 308/36.4 |
| 3,694,857 | 10/1972 | Nayfa | 19/62 |
| 3,774,982 | 11/1973 | Nakamura et al. | 308/187.1 |
| 3,959,851 | 6/1976 | Bledsoe | 19/48 A |
| 3,991,442 | 11/1976 | Miroshnichenko et al. | 19/53 |
| 4,094,043 | 6/1978 | Vandergriff | 19/53 |
| 4,153,976 | 5/1979 | Vandergriff | 19/53 |
| 4,262,390 | 4/1981 | Einglett et al. | 19/50 |
| 4,304,446 | 12/1981 | Goodine | 308/187.1 |
| 4,310,949 | 1/1982 | Vandergriff | 19/62 R |
| 4,400,851 | 8/1983 | Hudson | 19/55 R |
| 4,463,479 | 8/1984 | Nayfa | 19/62 R |

FOREIGN PATENT DOCUMENTS 888881 2/1962 United Kingdom .

*Primary Examiner*—Louis K. Rimrodt

*Attorney, Agent, or Firm*—Sigalos & Levine

[57] ABSTRACT

A ginning point assembly for use in conjunction with a cotton gin rib comprising a rectangular mounting plate for removable attachment to rib, first and second opposed recesses formed in plate, a roller mounted in each of recesses for rotation at ginning point in a direction transverse to the longitudinal axis of rib to which the plate is attached, and a shield attached to said mounting plate above said rollers to prevent said debris or cotton from interfering with the rotation of the rollers.

19 Claims, 14 Drawing Figures

FIG. 11
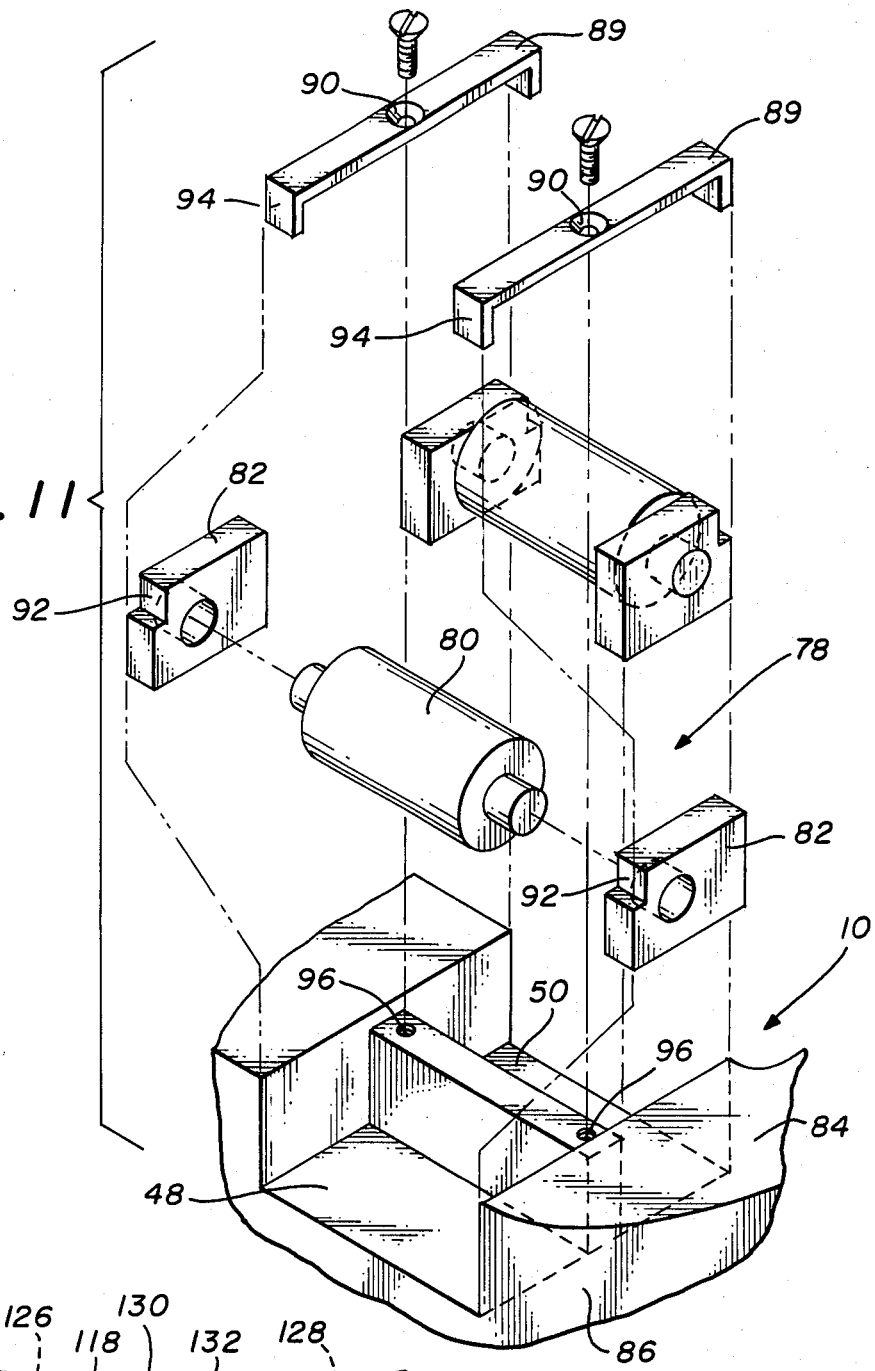
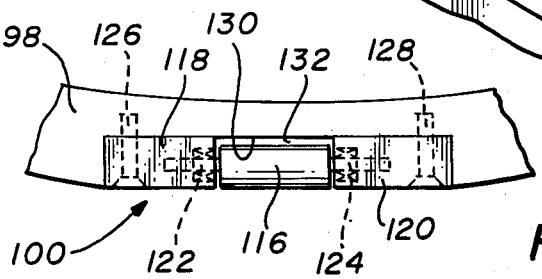
FIG. 14

GINNING POINT ASSEMBLY

BACKGROUND OF THE INVENTION

The present invention is a continuation-in-part application of application Ser. No. 586,544 filed Mar. 5, 1984 by James E. Nayfa and entitled "Ginning Point Assembly" now abandoned, and relates generally to cotton gins and cotton seed oil mills in particular to a ginning assembly which is mounted on each of a plurality of ginning ribs to enhance the efficiency of operation, increase the capacity, improve the ease of maintenance of the cotton gin and produce a superior grade of cotton from the gin itself.

The conventional cotton gin and cotton seed oil mill comprises a series of circular saws arranged at relatively close spacings along a rotating shaft with the saws operating between a series of ribs spaced to provide minimum clearance for the saws therebetween and to permit passage of cotton fibers impaled on the saw teeth but rejecting the seeds which are thus detached therefrom. Although cotton gin ribs are generally formed of metal, it has been found that extended use of such ribs created excessive wear at the ginning point occasioned by the abrasive action of substances such as cotton seeds, dirt, and trash which tended to cling to the cotton fibers. Thus it became necessary to remove and replace the ribs as they would wear. In addition, the pulling of the cotton fibers through the small space existing between the ginning ribs damaged the cotton fibers by bending or breaking them and thus caused a variation in the length of the fibers being pulled through that small space.

To improve the quality of the fibers being ginned and to minimize the excessive wear taking place at the ginning point, U.S. Letters Pat. No. 3,369,275, dated Feb. 20, 1968, issued to Charles L. Headley and assigned in part to James E. Nayfa, disclosed freely rotative rollers attached to the rib at the ginning point, the point where the fibers pass between the ribs, with the rollers being peripherally smooth and carrying the cotton fibers between the ribs at the other side. It was found out, however, that because the rollers were peripherally smooth they were not readily conducive to rotation by the movement of the fibers passing thereover and thus to that extent were not completely satisfactory for the purpose intended.

Thus, U.S. Pat. No. 3,694,857, dated Oct. 3, 1972 and issued to James E. Nayfa disclosed improved ginning ribs having freely rotative rollers attached to the rib at the ginning point wherein each disk had a series of serations formed on the periphery thereof and therefore was rotatable by the movement of the cotton fibers impaled thereon by the circular saw operating in conjunction therewith.

While this type of roller worked very effectively to accomplish the task it was designed to perform, i.e. produce greater amounts of cotton during a given time and reduce damage to the cotton fibers being ginned, it was found that maintenance of the ribs was still a problem and that as it became necessary to replace worn disks, it was required that each of the ginning ribs be removed and the rollers disassembled and new rollers installed on each rib and the ribs reassembled in the cotton gin. Of course, this requires an extensive amount of maintenance, time and, further, if the newly installed disks are installed improperly, they do not function in the manner intended because dirt and other particles get in the bearings of the disks and cause them to freeze up. While the present invention may also be used with cotton seed oil mills as stated previously, it will be discussed hereinafter with relation to cotton gins for ease of explanation.

In prior art patents U.S. Pat. Ser. Nos. 364,176 to Jordan and 374,193 to Libbey, a ginning assembly is mounted on each ginning rib at the ginning point thereof and has thereon rotating means for rotation in a direction transverse to the longitudinal axis of the rib to which the assembly is attached. Since the ginning points are all accessible from the top of each rib, the ginning point assembly may be removed or attached to the ginning rib at the ginning point without removal of the rib itself. In addition, because the rotating means rotates in a direction transverse to the longitudinal axis of the rib to which it is attached, the cotton being ginned or passing between the rollers passes directly in a straight line from one side of the ribs to the other. Since the cotton fiber travels a shorter distance from one side of the rib to the other than it does following the circumferential path of the rollers in U.S. Pat. No. 3,694,857, the speed at which ginning takes place is increased considerably. At the same time, however, the rollers tend to prevent the cotton fibers from being bent or broken and thus improve the quality of the fibers being ginned.

The basic concept of using such rollers mounted on each side of the rib and rotating in a direction transverse to the longitudinal axis of the rib is thus disclosed in U.S. Pat. Nos. 364,176 and 374,193. However, the prior art rollers mounted for rotation at the ginning point in a direction transverse to the longitudinal axis of the rib have not been entirely satisfactory inasmuch as fibers, sticks, grime and the like are pulled in between the roller and the rib and bind the rollers so that they cannot turn thus negating the advantageous effects that the rollers are intended to provide. The present invention overcomes these disadvantages by providing such rollers attached to the rib in such a manner as to minimize the amount of fibers, sticks, grime or other materials which can be caught in the rollers and thus keep the rollers free and rotating.

SUMMARY OF THE PRESENT INVENTION

Briefly stated, the present invention comprises a ginning point assembly for use in conjunction with a cotton gin rib for ginning cotton having seeds and associated debris comprising a rectangular mounting plate for removable attachment to said rib at the ginning point, first and second opposed recesses formed in said plate and rotating means mounted in each of said recesses for rotation at said ginning point in a direction transverse to the longitudinal axis of said rib to which said plate is attached and a shield attached to said mounting plate above said rollers to prevent said debris or cotton from interfering with the rotation of said rollers.

The present invention also comprises an improved ginning rib for attachment in a ginning machine between first and second mounting bars for ginning cotton having seeds and associated debris, said rib comprising a first body section having means for attachment to said first mounting bar, a second body section having means for attachment to said second mounting bar, an arcuate section integrally formed with and connecting said first and second body portions, a ginning point on said rib, rotating means removably mounted on said rib at said ginning point for rotation in a direction transverse to the longitudinal axis of said rib and a shield attached to said mounting plate above said rollers to prevent said debris or cotton from interfering with the rotation of said rollers.

BRIEF DESCRIPTION OF THE DRAWINGS

These and other more detailed objects and advantages of the present invention will be disclosed in conjunction with the accompanying drawings in which:

FIG. 11 discloses yet another embodiment of the present invention;

FIG. 14 is a partial side view of still another alternate embodiment of the present invention.

DETAILED DESCRIPTION OF THE DRAWINGS

Figure 1:
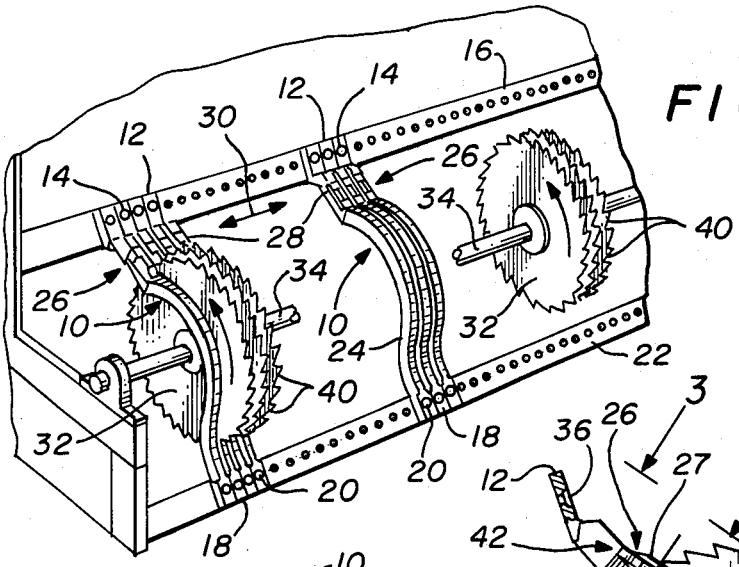
FIG. 1 is a diagrammatic representation of the ginning section of a cotton gin illustrating the ginning ribs and the saws interposed between the ginning ribs.

FIG. 1 is a partial perspective view of a gin saw assembly and a ginning rib assembly in a cotton gin. Ginning ribs 10 are arranged in parallel relationship and are generally constructed of a suitable metal, such as steel or a high impact plastic, and have a first body section 12 with means such as screw 14 for attachment to a first mounting bar 16. Each ginning rib 10 also has a second body portion 18 having means such as screws 20 for attachment to a second mounting bar 22. An arcuate section 24 of each of ginning ribs 10 is integrally formed with and connects first and second body portions 12 and 18. A ginning point 26 is located on each rib 10 near the juncture of first body portion 12 and arcuate section 24. A ginning point assembly 28 is mounted on each rib 10 at the ginning point 26 and includes a rotating means 52 and 54 as illustrated in FIG. 3 for rotation in a direction transverse to the longitudinal axis of said rib as indicated by the direction of arrow 30.

A corresponding number of saw blades 32 are formed on a saw cylinder 34 in parallel relationship and are associated with the ginning ribs 10 such that they are in an interposed relationship with said ginning ribs 10 and the teeth of each saw blade 32 passes between a pair of parallel ginning ribs 10 at the ginning point 26.

Figure 2:
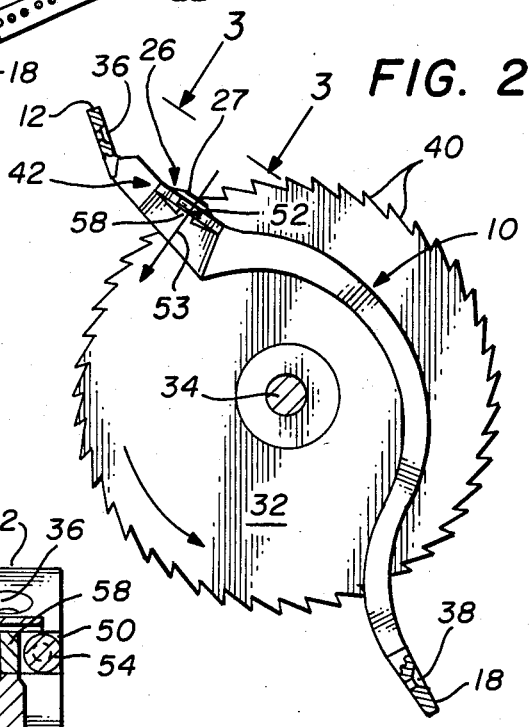
FIG. 2 is a side view of one of the ginning ribs of the present invention which has a ginning assembly mounted thereon at the ginning point.

As can be more clearly seen in FIG. 2, a ginning rib 10 has the first body section 12 with an orifice 36 therein in order to attach section 12 to a mounting bar 16 as disclosed in relation to FIG. 1. In addition, the second body section 18 has an orifice 38 therein for attachment to a second mounting bar 22 as illustrated in FIG. 1. Saw 32 is associated with rib 10 in such a way that the teeth 40 of saw 32 pass through the ginning point 26 of rib 10. It will be noted that the novel ginning point assembly 42 including a shield 27 is mounted on ginning rib 10 at ginning point 26.

Figure 3:
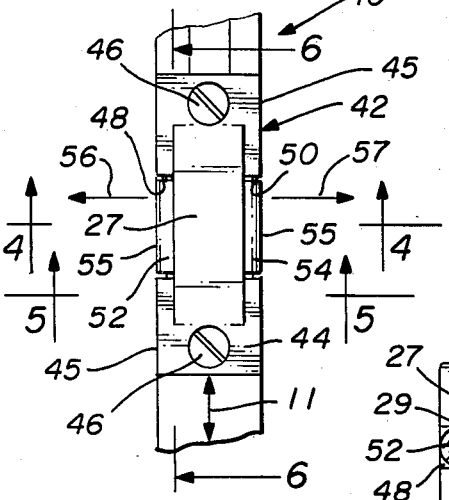
FIG. 3 is a plan view of the ginning point assembly attached to the ginning rib at the ginning point.

FIG. 3 is a top view of the ginning point of rib 10 with the novel ginning point assembly 42 mounted thereon. As will be seen in FIG. 3, the ginning point assembly 42 comprises a rectangular mounting plate 44, which may be formed of a suitable metal such as steel or a high impact plastic, for removable attachment to rib 10 by any well known means such as screws passing through orifices 46 to the rib 10 body. Other types of removable fasteners also could be used such as clips or bolts. Rectangular mounting plate 44 has formed therein a first recess 48 and a second recess 50 opposed to each other on opposite sides of mounting plate 44 with each rotating means 52 and 54 mounted in a corresponding one of said recesses 48 and 50 for rotation towards that side of rib 10 at the ginning point in a direction transverse to the longitudinal axis 11 of said rib 10 to which plate 44 is attached. A shield 27 is integrally formed with plate 44 to cover at least a portion of rollers 52 and 54 to prevent cotton fibers or other debris such as sticks, grime, dirt and the like from entering the rollers and interfering with the rotation thereof. The shield extends in width from at least the center line of one roller 52 to the center line of the other roller 54. Thus, during the ginning operation, rotating means 52 rotates toward its side of rib 10 in the direction of arrow 56 while rotating means 54 rotates towards its side of rib 10 in the direction of arrow 57. It can be seen from FIG. 3 that the removal and installation of ginning point assembly 42 from rib 10 does not require removal of the rib 10 from the cotton gin but simply requires removal of the means fastening rectangular mounting plate 44 to rib 10 such as screws in orifices 46. The old ginning point assembly 42 can be removed and the new ginning point assembly 42 installed in like manner. Further, because the rectangular mounting plate 44 is symmetrical about both its longitudinal and transverse axes, it may be attached to rib 10 without reference to a particular physical relationship with respect to rib 10. It cannot be mounted or attached to rib 10 incorrectly.

Figure 4:
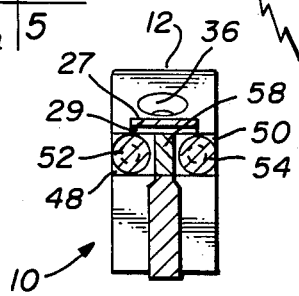
FIG. 4 is a cross-sectional view of the rollers mounted in the ginning point assembly.

FIG. 4 is a cross-section view of the rectangular mounting plate 44 taken along section 4—4 in FIG. 3. As can be seen in FIG. 4, rotating means 52 and 54 are solid cylindrical rollers made of a suitable material such as steel and which are mounted in first and second recesses 48 and 50 of the rectangular mounting plate 44. Divider 58 simply forms part of the rectangular mounting plate and separates the two rollers 52 and 54. Divider 58 could be formed in the rib 10 itself by forming recesses 48 and 50 in the rib 10, one on each side thereof.

Figure 6:
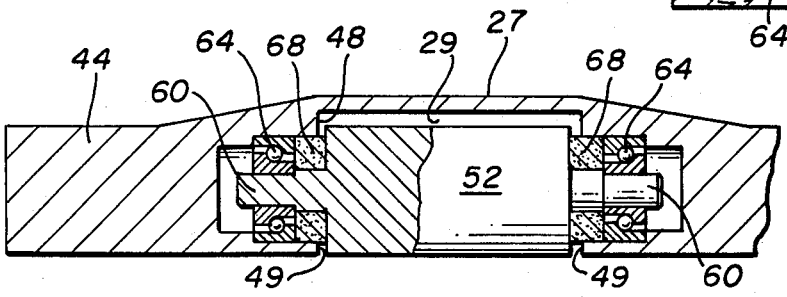
FIG. 6 is a longitudinal cross-sectional view of one of the rollers of the ginning point assembly illustrating the bearings, the shield and the seal which prevents contaminates from entering the bearings.
Figure 7:
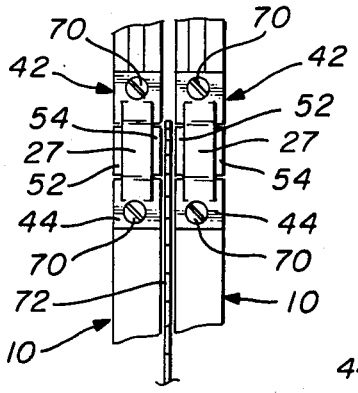
FIG. 7 is a plan view of two of the ginning ribs in side by side relation with a saw therebetween illustrating how the rollers on opposing ginning point assemblies work together to feed the cotton between the ginning ribs to the other side.
Figure 8:
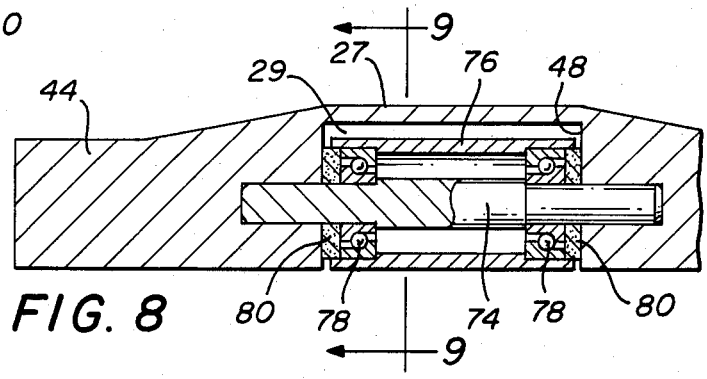
FIG. 8 is a longitudinal cross-sectional view of an alternate type of roller which may be mounted in the ginning point assembly.

It will be noted in FIGS. 4, 6, and 8 that rollers 52 and 54 have an outside diameter equal to the thickness of said mounting plate 44. It will also be noted in FIGS. 3 and 7 that the cylindrical rollers 52 and 54 are mounted in recesses 48 and 50 such that the outer surface 53 of said rollers 52 and 54 are flush with the outer edge 45 of mounting plate 44. Thus, wear at the ginning point is minimized because of the rolling contact between the cotton fibers and the rollers 52 and 54.

Figure 5:
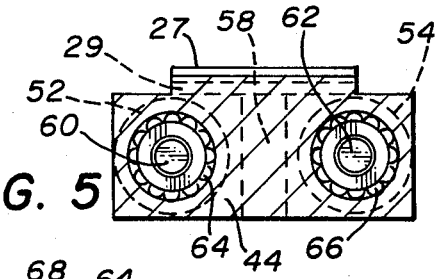
FIG. 5 is a cross-sectional view of the bearing section of the rollers in the ginning point assembly.

FIG. 5 is a cross-sectional view taken along lines 5—5 of FIG. 3 which illustrates the bearing supports for the rollers 52 and 54 as shown in FIG. 3 and FIG. 4. Thus, as can be seen in FIG. 5, the end shafts 60 and 62 of rollers 52 and 54 are of a smaller diameter than the roller body and are mounted in bearing races 64 and 66 respectively in rectangular mounting plate 44 in each end of each recess 48 and 50. These same bearings appear on both end shafts 60 and 62 thus allowing free rotation of both rollers 52 and 54. It will be noted that shield 27 extends in width from the center line of roller 52 to the center line of roller 54. The distance 29 between the shield 27 and rollers 52 and 54 ranges from a minimum of 0.03125 inch (1/32 inch) to a maximum of 0.0625 inch (1/16 inch). In this range, a minimum of cotton fibers, grain, dirt, sticks and the like will be pulled into the rollers by centrifugal force thus allowing the rollers to operate most efficiently.

FIG. 6 is a cross-sectional view of the rectangular mounting plate 44 shown in FIG. 3 and taken along lines 6—6. Thus as can be seen in FIG. 6, each end 62 of roller 52 is mounted in a bearing race 64 placed in each end of recess 48 in rectangular mounting plate 44. In addition, a washer 68, which may be formed of felt or other suitable material, is interposed between bearing 66 and the end 49 of recess 48 to prevent dirt or other contaminates from reaching bearing 64.

FIG. 7 is a top view of two ginning ribs 10 in parallel relationship with a saw blade 32 interposed between them. It will be noted that the teeth 72 of saw 32 pass through the ginning point of ribs 10 where rollers 52 and 54 are located. It will also be seen in this view that the ginning point assembly 42, including rectangular mounting plate 44, is attached to each rib 10 by means such as screws 70. This allows for simple attachment and removal of the rectangular mounting plate 44 as needed without the necessity of removing any of the ribs 10 from the cotton gin itself. It will be seen in FIG. 7 that roller 54 of the left rib 10 works in conjunction with roller 52 of right rib 10 to allow the cotton being carried by teeth 72 of saw blade 32 to pass easily and directly between the rollers 52 and 54 to the other side of ribs 10 thus effectively removing the seeds and protecting and minimizing the damage to the cotton fibers by rolling the fibers between the ribs 10 to the other side. Unlike the disk type rollers previously described in relation to the prior art which rotate in a direction parallel to the longitudinal axis of ribs 10 and which require the cotton fibers to follow a longer path by being carried forwardly and downwardly as the disk rotates, the cotton fibers in the present invention follow a very short path directly between the rollers to the other side. This short path is illustrated by arrow 53 in FIG. 2. This allows a large increase in production of cotton over the prior art disk type ginning ribs as well as the production of better and more valuable cotton fibers having a more uniform length and which fibers are less likely to be torn or mutilated.

FIG. 8 is a cross-sectional view of an alternate type of rectangular mounting plate 44 which has a solid shaft 74 fixedly positioned in each recess 48 and 50 of rectangular mounting plate 44 and having surrounding it a rotatable cylinder 76 which has bearings 78 interposed between cylinder 76 and solid rod 74. Cylinder 76 then freely rotates about solid shaft 74 on bearings 78. In addition, a washer 80 is interposed between bearing 78 and the outer ends of rotatable cylinder 76 to prevent any dust or other contaminates that get past shield 27 from entering bearings 78.

Figure 9:
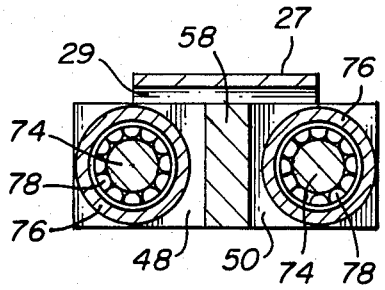
FIG. 9 is a cross-sectional view of the alternate type of roller shown in FIG. 8.

FIG. 9 is a cross-sectional view of the alternate type of roller unit taken along lines 9—9 in FIG. 8 and illustrates rectangular mounting plate 44 having first and second recesses 48 and 50 in which solid shaft 74 is fixedly mounted and about which cylindrical roller 76 is mounted and which rides on bearings 78 which are interposed between solid shaft 74 and cylindrical roller 76. Again, divider 58 is a portion of the rectangular mounting plate 44 and separates the two recesses 48 and 50.

Figure 10:
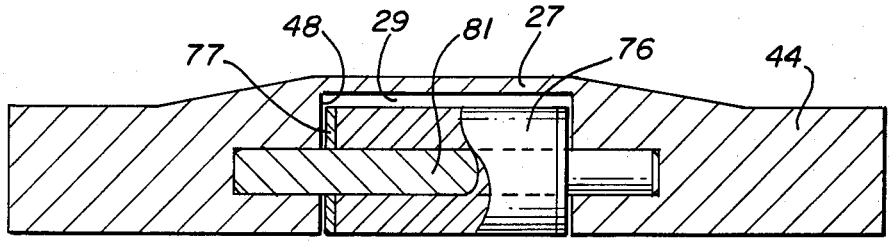
FIG. 10 discloses another alternate embodiment of the present invention.

FIG. 10 discloses another alternate embodiment in which a solid shaft 81 is rigidly mounted in each end of each recess, such as recess 48, of rectangular mounting plate 44 with a cylindrical roller 76 rotatably mounted on said shaft 81. The shaft, for example, may be made of a high impact plastic such as DELRIN, a DuPont trademark, which provides a natural lubrication for the cylindrical roller 76 rotatably mounted thereon. A bushing 77, made of the proper material such as felt or DELRIN, depending upon the materials used to form roller 76 and shaft 81, may be inserted between roller 76 and recess 48 to prevent any dirt or other contaminates which get past shield 27 from entering the bearing surface between roller 76 and shaft 81. Of course, other combinations of metals and plastics can be used so long as the cylindrical roller 76 freely rotates about solid shaft 81.

FIG. 11 discloses yet another embodiment of the present invention. In this embodiment, opposed recesses 48 and 50 are formed in the body of rib 10 at the ginning point. A rotatable assembly designated generally by the numeral 78 comprises a roller 80 integrally formed with bearing block assemblies 82 to form a unitary assembly 78. First and second such assemblies can be mounted in recesses 48 and 50. Assembly 78 fits in either of recesses 48 or 50 such that roller 80 is flush with the top 84 and side 86 of rib 10. A plate 88 having an orifice 90 may be used to removably mount assembly 78 in both recesses 48 and 50. Indentation 92 may be formed in bearing blocks 82 to accommodate finger 94 on plate 88 so that the entire assembly 78 may be flush with the top 84 and side 86 of rib 10. A screw may be used through orifice 90 in plate 88 to mate with threaded orifice 96 in rib 10 to hold plate 88 securely over roller assembly 78 to maintain the assembly in each recess 48 and 50. Obviously, indentation 92 on bearing block assembly 82 must be to the outside of each recess 48 and 50 so indentation 92 on each end of plate 88 will mate accordingly. Each roller 80 will rotate in a direction transverse to the longitudinal axis of said rib as described earlier with the other embodiments.

Either or both rotatable assemblies may be removed and replaced simply by removing plate 88, lifting the rotatable assembly 78 from either or both recesses 48 and 50, putting a new rotatable assembly 78 in either or both recesses 48 and 50 and replacing plate 88 and fastening it to rib 10 with a screw. Of course, a shield 27, such as that shown in FIG. 10, could be used with this embodiment.

Other variations of this modification could be used such as separate or individually removable bearing blocks to fit in a bearing block holder in each end of each recess to hold a roller shaft. A plate could be fastened over each bearing block to hold it secured in the recess. Such modifications are contemplated with this embodiment.

Figure 12:
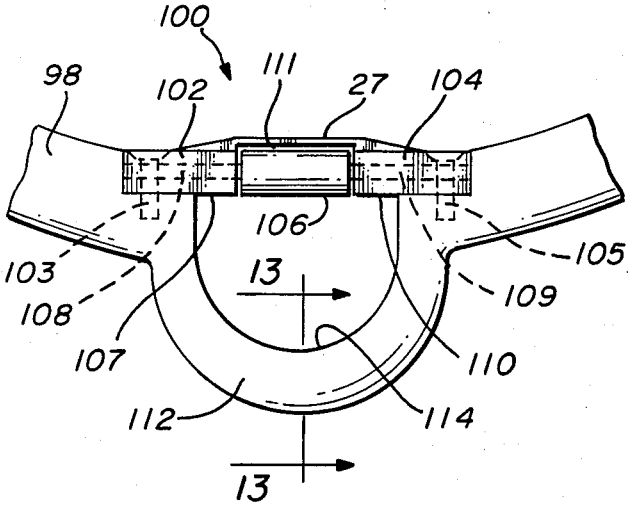
FIG. 12 is an alternate embodiment of a ginning rib with the present invention mounted thereon.

In the process of ginning cotton, the centrifugal force created by the rotation of the rollers causes dirt, grime and other materials to fill in between the rollers and thus impede the rotation thereof. One way of solving this problem is to use the alternative embodiment shown in FIG. 12 in which the rib 98 is formed with a loop 112 under the roller assembly 100 in the form of an arch with the roller assembly 100 spanning the arch. This leaves a gap under the rollers so that dust, dirt and other particles can fall down below the rollers and not accumulate between the rollers and the rib.

Also, end plates 102 and 104 of the roller assembly 100 are fastened to the rib 98 so as to create spaces 107 and 110 betweeen the ends of the rollers 106 and the rib 98. If the rib loop 112 is coterminus with the ends of mounting blocks 102 and 104, again centrifugal force allows the build-up of grime and dirt between the end of the mounting blocks 102 and 104 and the rollers. However, with spaces 107 and 110 the grime, dust and dirt tend to build-up in those areas thus not interfering with the rotation of the rollers.

Figure 13:
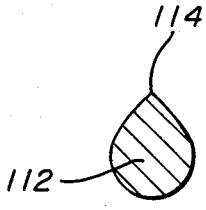
FIG. 13 is a cross-sectional view of the rib taken along lines 13—13 in FIG. 12.

Further, as can be seen in FIG. 13, the cross-sectional shape of rib loop 112 has a V-shaped apex 114 which allows any dust, dirt and grime to fall off of the rib loop 112 rather than accumulate thereon. If the upper portion of loop 112 is in the form of a arc or otherwise flat surface, build-up of the unwanted materials can occur.

A further embodiment of the invention to prohibit dirt and grime build-up is illustrated in FIG. 14 where the roller assembly 100 is mounted under the rib 98 as shown. Screws 126 and 128 pass through end brackets 118 and 120 to hold the assembly to rib 98. Gap 132 exists between the upper portion 130 of rib 98 and the rollers as discussed earlier and thus the rib 98 serves as the shield 27 shown in FIG. 12 for instance and gap 132 has the minimum width of 0.03125 inches and a maximum width of 0.0625 inches. In this case, of course, it is obvious that there is no structure existing beneath the rollers at all which can cause a build-up of dirt particles.

Thus, there has been disclosed a novel improvement in a ginning point assembly for use in conjunction with a cotton gin rib which allows a greater capacity to gin cotton and which not only protects the cotton fibers from damage due to their movement between the ginning ribs but which also allows quick and economical replacement of said ginning point assemblies whenever wear necessitates.

While the invention has been described in relation to suitable metals such as steel forming the parts thereof, it is also contemplated that other materials such as high impact plastics could also be used and such are encompassed within the scope of the invention.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined in the appended claims.

I claim:

1. A ginning point assembly for use in conjunction with a cotton gin rib for ginning cotton having seeds and associated debris comprising:

a. a rectangular mounting plate for removable attachment to said rib at the ginning point, b. first and second opposed recesses formed in said plate, c. rotating means mounted in each of said recesses for rotation at said ginning point in a direction transverse to the longitudinal axis of said rib to which said plate is attached, and d. a shield attached to said mounting plate above said rotating means to prevent said debris or cotton from interfering with the rotation of said rotating means.

2. An assembly as in claim 1 wherein said shield is attached to said mounting plates so as to create a gap between said shield and said rotating means in the range of 0.03125 to 0.0625 inches.

3. An assembly as in claim 2 wherein said shield has a width extending from the center line of one rotating means to the center line of the other rotating means.

4. An assembly as in claim 3 wherein said rotating means comprises:

a. a solid shaft fixedly positioned in each of said recesses, and b. a cylindrical roller rotatably mounted on each of said solid shafts.

5. An assembly as in claim 3 wherein said rotating means comprises:

a. a bearing mounted in said mounting plate in each end of said recess, b. a cylindrical roller having each end mounted in one of said bearings in said mounting plate, and c. a washer interposed between each said bearing and each end of said mounting plate recess to prevent dust and other contaminates from entering said bearing.

6. An assembly as in claim 5 wherein said washer is constructed of a felt material.

7. An improved ginning rib for attachment in a ginning machine between first and second mounting bars for ginning cotton having seeds and associated debris, said rib comprising:

a. a first body section having means for attachment to said first mounting bar, b. a second body section having means for attachment to said second mounting bar, c. an arcuate section connecting said first and second body portions, d. a ginning point on said rib, e. rotating means removably mounted on said rib at said ginning point for rotation in a direction transverse to the longitudinal axis of said rib, f. a shield mounted above said rotating means to prevent said debris or cotton from interfering with said rotating means.

8. A rib as in claim 7 wherein said shield is attached to said rib so as to create a gap between said shield and said rotating means in the range of 0.03125 to 0.0625 inches.

9. An assembly as in claim 8 wherein said shield has a width extending from the center line of one rotating means to the center line of the other rotating means.

10. An improved ginning rib as in clain 9 wherein said rotating means comprises:

a. a first roller mounted on one side of said rib for rotation in a direction toward said one side, and b. a second roller mounted on the other side of said rib opposite said first roller for rotation in a direction toward said other side.

11. An improved ginning rib as in claim 10 further having a ginning point assembly including:

a. a rectangular mounting plate for removable attachment to said rib, b. first and second opposed recesses formred in said mounting plate, and c. means for mounting said first roller in one of said recesses and said second roller in the other of said recesses.

12. An improved ginning rib as in claim 11 wherein said shield is integrally formed with said mounting plate over said rollers.

13. A rib as in claim 12 further comprising:

a. a downwardly extending loop formed in said rib at said ginning point, and b. means for attaching said mounting plate to said rib so as to span said loop thereby creating a gap under said first and second rollers to prevent said debris from accumulating under said rollers.

14. A rib as in claim 13 wherein said rib loop is formed with a V-shape in cross-section having the apex facing upwardly toward said rollers thereby avoiding accumulation of said debris under said rollers on said rib loop.

15. A rib as in claim 14 wherein said mounting plate is attached to said rib spanning said loop such that a space exists between each end of said roller and said rib whereby any accumulation of debris is in said space away from said rollers.

16. A ginning point assembly for use in conjunction with a cotton rib for ginning cotton having seeds and associated debris comprising:

a. a first rotatable assembly removably mounted on one side of said rib at said ginning point for rotation in a direction transverse to the longitudinal axis of said rib, b. a second rotatably assembly removably mounted on the other side of said rib in opposed relationship to said first rotatable means, said second rotatable means mounted for rotation in a direction transverse to the longitudinal axis of said rib, and c. a shield mounted above said first and second rotatable assemblies to prevent said debris or cotton from interfering with said rotating means.

17. A ginning point assembly as in claim 16 further comprising:

a. first and second opposed recesses formed in said rib at said ginning point, and b. means for removably mounting said first and second rotatable assemblies in a corresponding one of said recesses for rotation at said ginning point in a direction transverse to the longitudinal axis of said rib, each of said assemblies being mounted flush with the top and side of said rib recess, said shield forming a cover over said assemblies to prevent debris from adversely affecting rotation of said rotating means.

18. A ginning point assembly for use in conjunction with a cotton gin rib for gining cotton having seeds and associated debris comprising:

a. a rectangular mounting plate for attachment to the underside of said rib at the ginning point, b. first and second opposed recesses formed in said plate, and c. rotating means mounted in each of said recesses for rotation at said ginning point in a direction transverse to the longitudinal axis of said rib to which said plate is attached.

19. A ginning point assembly as in claim 18 further including:

a. a notch formed on the underside of said rib for receiving said mounting plate, and b. means for attaching said mounting plate to the underside of said rib such that a gap in the range of 0.03125 to 0.0625 inches exists between said rib and said rotating means whereby said rib serves as a shield for said rotating means to prevent debris from interfering with the rotation of said rotating means.

* * * * *

UNITED STATES PATENT AND TRADEMARK OFFICE

CERTIFICATE OF CORRECTION

PATENT NO. : 4,625,365

DATED : December 2, 1986

INVENTOR(S) : James E. Nayfa

It is certified that error appears in the above-identified patent and that said Letters Patent are hereby corrected as shown below:

IN THE CLAIMS:

Column 8, line 52, the term --and-- was omitted at the end of the line following "rib", Column 8, line 62, "clain" should be --claim--.

Column 9, line 5, "formred" should be --formed--.

Signed and Sealed this

Thirty-first Day of March, 1987

*Attest:*

DONALD J. QUIGG

*Attesting Officer*

*Commissioner of Patents and Trademarks*